United States Patent [19]

Valero

[11] Patent Number: 4,582,003

[45] Date of Patent: Apr. 15, 1986

[54] FOLDING CORRUGATED BOARD DISPLAY SHELVING

[75] Inventor: Kenneth W. Valero, Pequannock, N.J.

[73] Assignee: Ultimate Display Corporation, Englewood, N.J.

[21] Appl. No.: 658,486

[22] Filed: Oct. 9, 1984

[51] Int. Cl.[4] ..... A47B 3/00

[52] U.S. Cl. ..... 108/111; 108/3; 211/132; 211/195

[58] Field of Search ..... 211/195, 149, 132; 108/111, 112, 3, 2; 312/262, 259

[56] References Cited

U.S. PATENT DOCUMENTS

| | | | |
|---|---|---|---|
| 1,559,878 | 11/1925 | Humphreyes | 312/262 |
| 4,271,766 | 6/1981 | Schmiedler | 108/111 |
| 4,415,090 | 11/1983 | Bustos | 211/195 |
| 4,493,424 | 1/1985 | Smith | 211/132 |

*Primary Examiner*—James T. McCall

*Attorney, Agent, or Firm*—Stoll, Wilkie, Previto & Hoffman

[57] ABSTRACT

A unitary multiple-shelved folding display stand intended to be made principally from corrugated board comprising a pair of triple-layer board side wall members hingedly affixed to a double-board rear wall panel and able to fold backwardly flat against the back side of the rear wall panel. The side wall members are joined by a plurality of elastic bands removably affixed near the forward edges of the side wall members by means of formed shelf support members removably secured to the side wall members. A plurality of triple-layer board shelves are hingedly secured to the front of the rear wall panel so that they may fold flush against the rear wall panel for storage or transportation and be unfolded down against the formed shelf support members for horizontal location and load-bearing support. When the side wall members are folded rearwardly against back of the rear wall panel the shelves are held in folded position against the front of the rear wall panel by means of the stretched elastic bands extended against them.

3 Claims, 9 Drawing Figures

FOLDING CORRUGATED BOARD DISPLAY SHELVING

BACKGROUND OF THE INVENTION

The invention is with respect to foldable shelf displays generally intended for supermarket or food store displays of products such as bakery goods and other reasonably moderate weight products for which movable lightweight for promotional displays are desirable. Such displays should offer resilience and lightweight durability which properly designed corrugated board can economically provide. Such displays as presently known in the art to applicants is exemplified by U.S. Pat. No. 4,151,803, issued May 1, 1979, of which the present applicant is a co-patentee.

SUMMARY OF THE INVENTION

The invention comprises the unitary folding shelf display made of corrugated board in which shelves and side wall members are hingedly secured to a common rear wall member. While the shelf members being foldable flat against the front face of the rear wall panel, it is of particular note to the invention that the pair of side wall members, attached to each other through extensible elastic bands, are hinged so as to fold rearwardly, flush against the back face of the rear wall panel, stretching the elastic bands tightly against the folded shelves and holding them in position against the front face of the rear wall panel, yielding a flat, rigid, portable unit.

It is a further particular point of the invention that the elastic band members are secured to the pair of side wall members through formed shelf support members which have the dual function of joining the elastic bands to the side walls as well as providing load-bearing support for the front of the shelf members when they are unfolded to receive products for display. The combination of elastic tension members holding side wall members tightly against the shelves, together with the formed shelf support members providing rigid mechanical support for the shelves, provides a remarkably strong, rigid display unit with unusual capacity and durability for corrugated board display units.

DESCRIPTION OF THE PREFERRED EMBODIMENT

Figure 2:
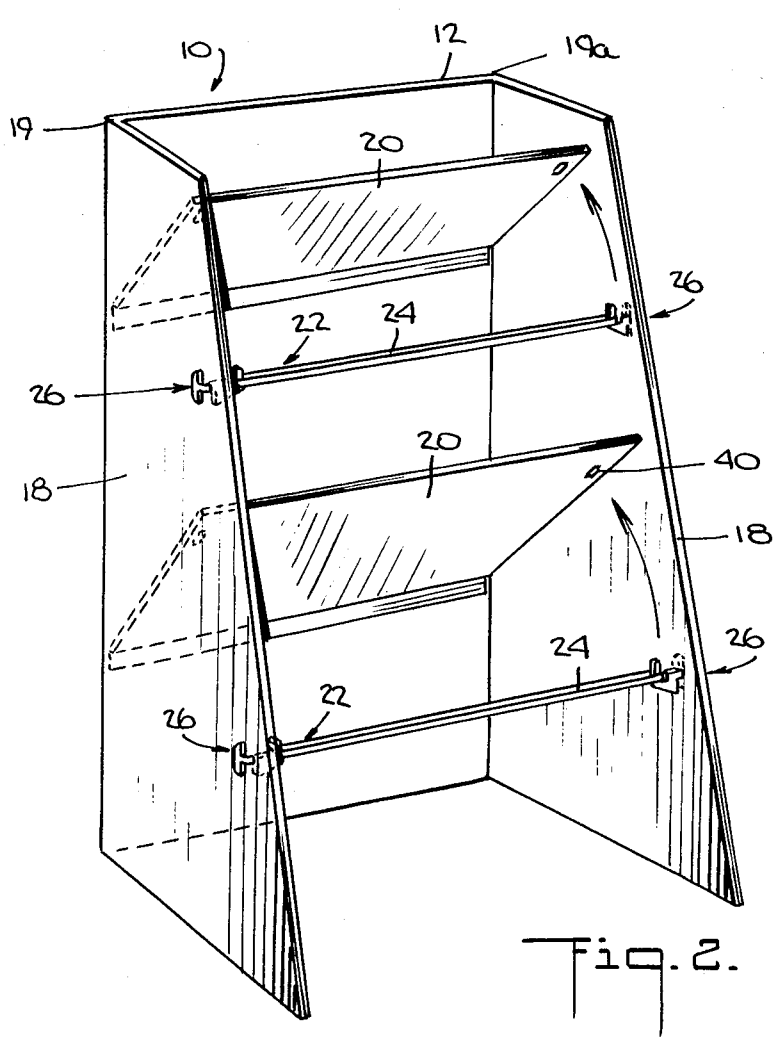
FIG. 2 is a view similar to that of FIG. 1 with the shelves lifted and partially folded to the rear wall member to show the elastic band and shelf support member support means of the present invention.
Figure 1:
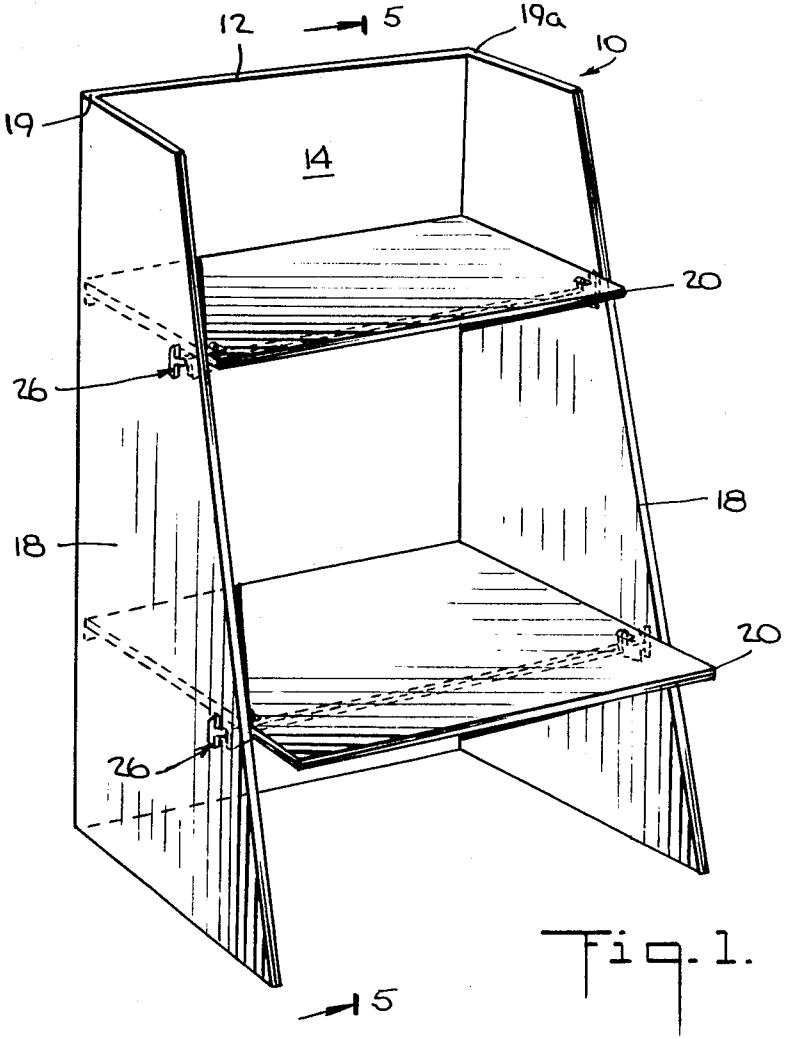
FIG. 1 is a front perspective view of the foldable corrugated board display unit of the present invention in unfolded display position. Portions of the shelves and of the shelf support system are shown in phantom.

With reference to the drawing, the foldable corrugated board display unit 10 comprises a rear wall panel 12 having a front face 14 and a rear face 16. Hingedly secured to rear wall panel 12, or formed integrally there with as will hereinafter be described, are a pair of side wall panel members 18, the respective hinge axis of rotation being substantailly parallel to each other. When side wall members 18 are positioned parallel to each other and extending perpendicularly forward of front face 14 of rear wall panel 12, the bottom edges of the side wall and rear wall panels are planar for forming a floor support for unit 10. When standing on a horizontal support, and in unfolded display position, rear wall panel 12 and side wall members 18 are substantially vertical.

Hingedly secured to front face 14 of rear wall panel 12 are a plurality of shelves 20, with the hinge axis for each shelf being substantially horizontal when the unit is unfolded on a floor. Each shelf member 20 may be hingedly folded upwardly substantially flush against front face 14 of rear panel 12, or lowered to a substantially horizontal position and held in place as will hereinafter be described.

Connecting between the side wall members 18 are a plurality of shelf support means 22, equal in number to the number of shelves 20 provided on a particular unit 10, each shelf support means 22 comprising an elastic band member 24 and a pair of formed shelf support members 26, one at each end of each elastic band.

Each formed shelf support member 26 comprises a side wall engaging locking bar 28, a load-bearing section 30 connected to the locking bar 28 by means of a curved link member 32. Load-bearing section 30 has an upwardly extending shelf-engaging pin member 34 and a downwardly extending side wall support flange 36. In the preferred embodiment it is preferred that load-bearing section 30 including shelf engaging pin 34 and side wall support flange 26, as well as side wall engaging locking bar 28, be relatively flat and vertically extending when in operative position on a standing unit 10.

Formed shelf support member 26 is secured to a side wall member 18 by means of inserting it through a horizontally elongated hole 38 formed in the side wall member for the purpose. To accomplish this it is necessary to turn the formed shelf support member 26 90° so that it may easily be inserted through the horizontally elongated hole 38, and then, when through the hole, turned 90° to the upright position so that engaging bar 28 is on the outside of side wall 18 and load-bearing section 30 is on the inside of side wall 18 with curved link member 32 extending through hole 38. Formed shelf support member 26 is now secured against removal from side wall 18 although it can rotate in a horizontal plane for folding purposes as will be described.

Shelf 20 is provided with a recess or hole 40 into which or through which shelf-engaging pin 34 is engaged when shelf 20 is lowered to a horizontal position onto formed shelf support member 26. While the shelf engages pin 34, it actually rests on the upper shelf support surface 42 of load-bearing section 30 and the shelf load is transferred to side wall members 18 by means of load-bearing section 30, with the shelf resting on support surface 42 and side wall support flange 36 engaging against side wall 18.

A recess 46 is provided between shelf engaging pin 34 and load-bearing section 30 for receiving and holding elastic band 24.

Operation of folding unit 10 of the present invention is now clear. When in unfolded, erect display condition, shelves 20 are substantially horizontal and are supported along their rear edge by the hinge engagement means with front face 14 of rear wall panel 12, and are supported at their front edge by each of side wall support flanges 26 which are in turn supported in side wall members 18. Unit 10 may be folded to compact dimensions by raising the front edge of each shelf 20 and folding it back against front face 14 of rear wall panel 12. Side walls 18, which were locked in place by shelves 20 when in display condition, may now be folded backwardly and flat against back surface 16 of rear wall panel 12. In doing so, elastic bands 24 are stretchedto wrap around the folded unit as may clearly be seen in FIG. 7. In doing so, they engage around folded shelves 20, holding the shelves in upright position flat against rear wall panel 12. To unfold the unit for display purposes side panels 18 are simply folded around until they are substantially parallel and forward of rear wall panel 12 at which point shelves 20 can be folded down until they rest on shelf support members 26 and are locked into place with pin members 34. Elastic band members 24 remain under tension holding side wall members 18 tightly against shelves 20 and shelves 20 locking the side wall members into place through formed shelf support members 26.

Figure 4:
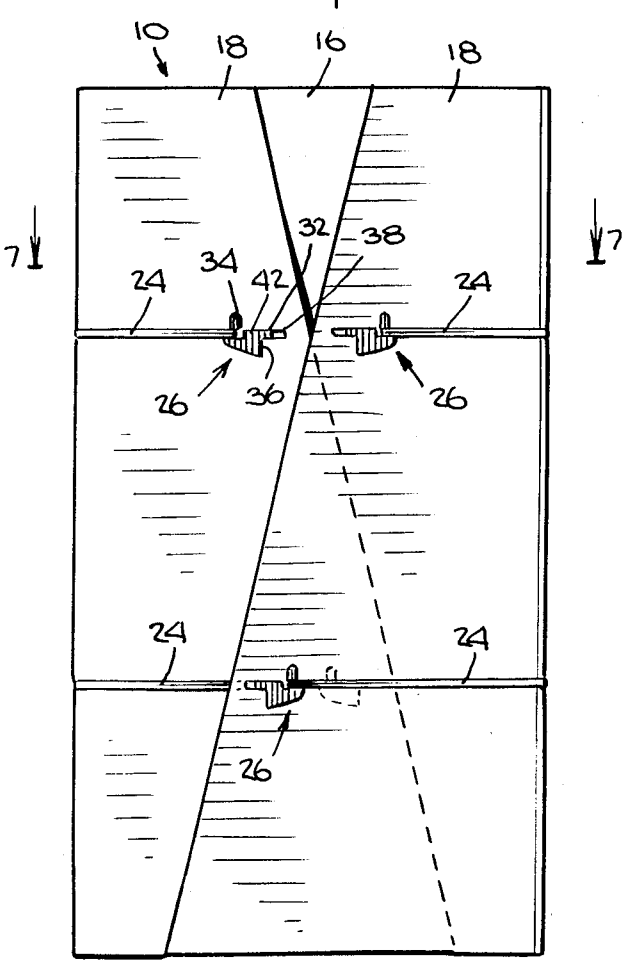
FIG. 4 is a back view of the folded corrugated board display unit of the present invention.
Figure 3:
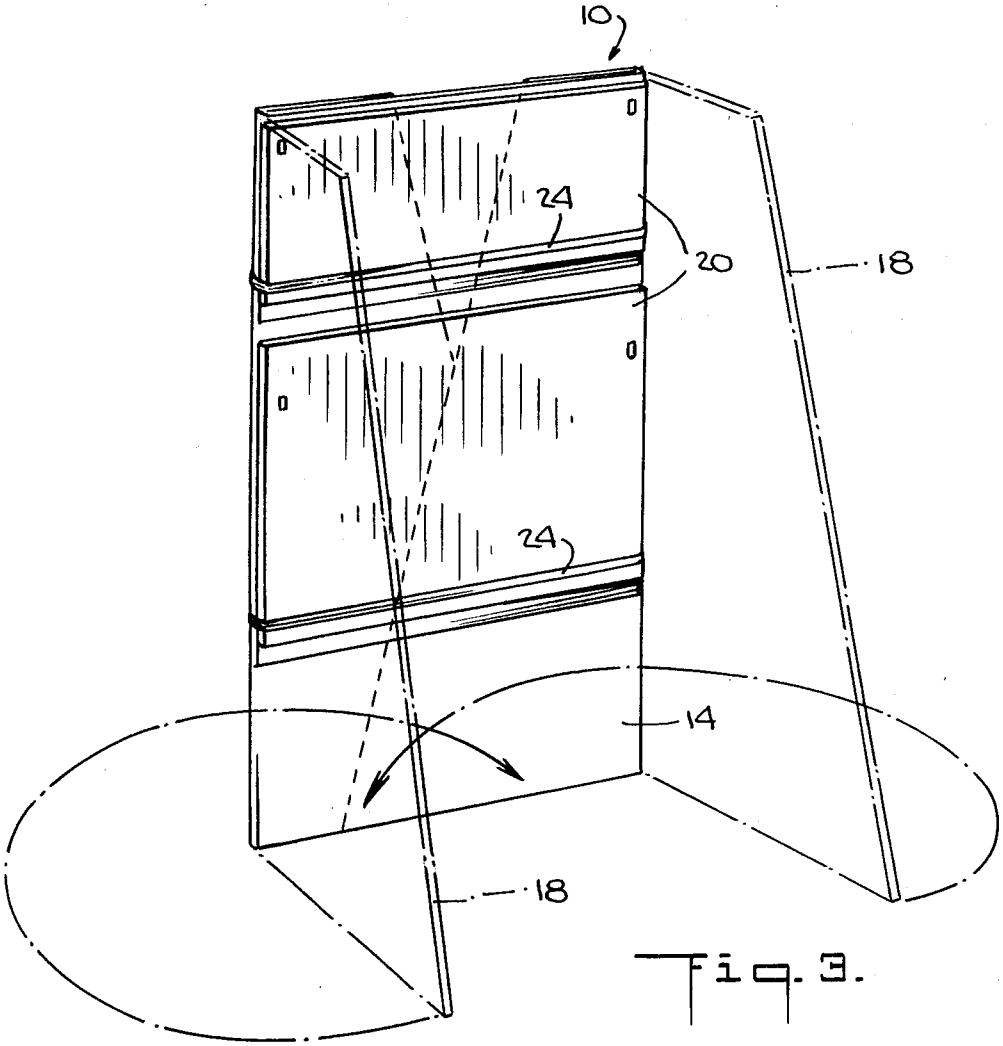
FIG. 3 is a view similar to that of FIG. 1 but in which the side wall and shelf members are folded against the rear wall panel with the directions of fold of the side wall members being in phantom.
Figure 5:
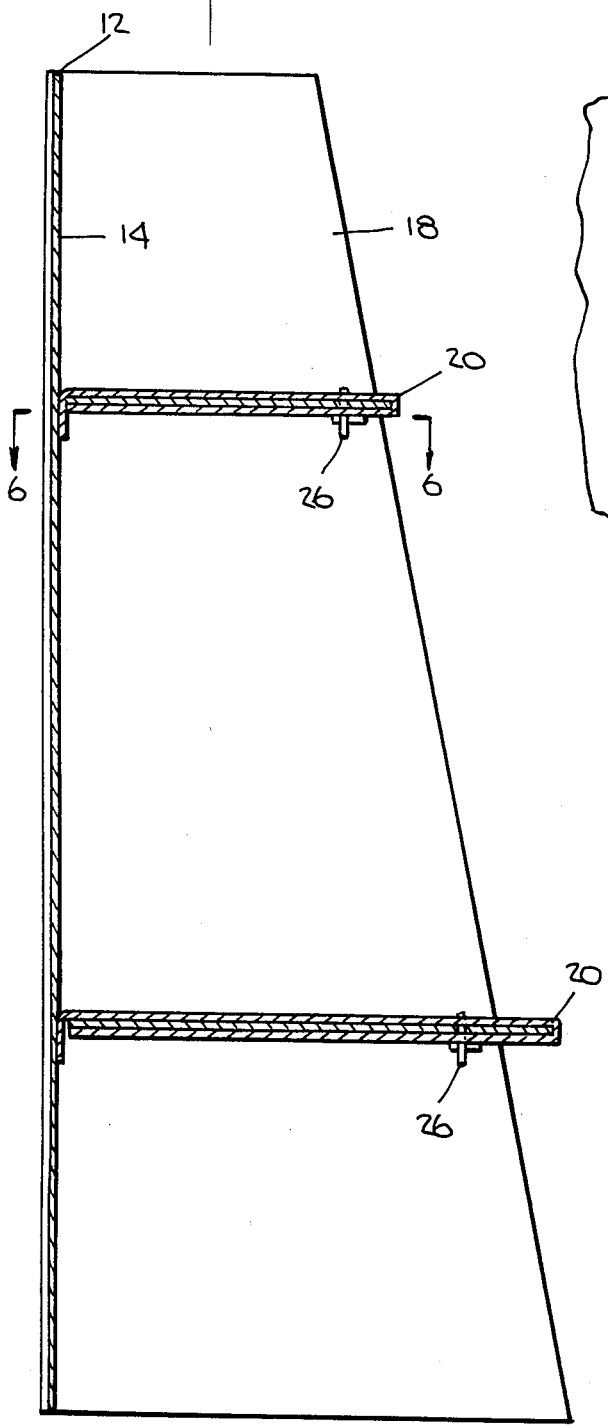
FIG. 5 is a cross-sectional view taken across line 5—5 of FIG. 1.
Figure 8:
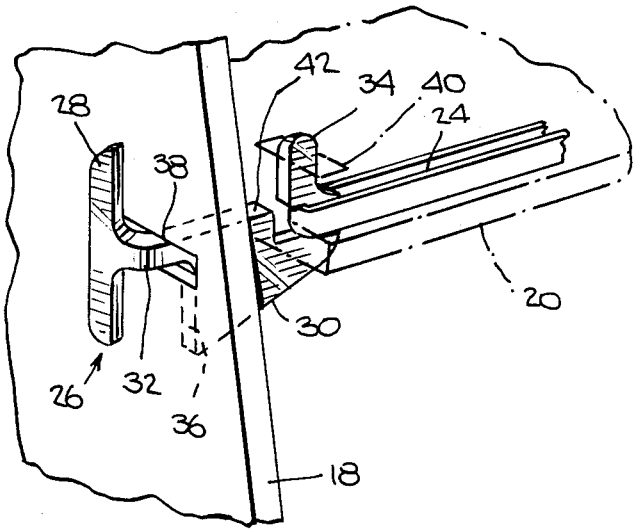
FIG. 8 is an enlarged fragmentary view of a side wall member showing the formed shelf support member and the elastic band when in unfolded display position.
Figure 9:
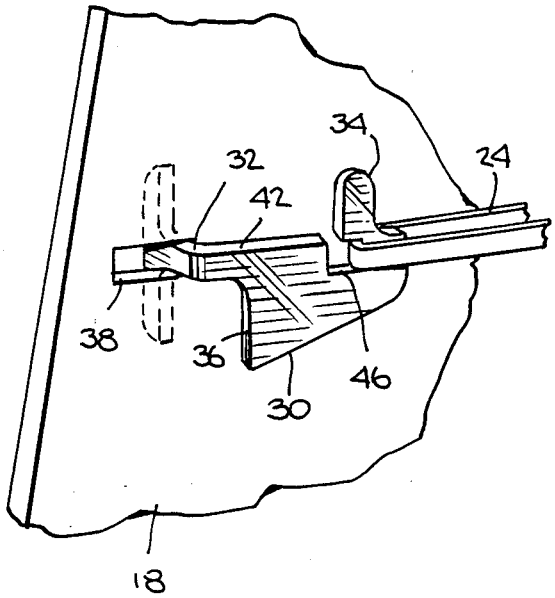
FIG. 9 is an enlarged fragmentary view of a portion of a side member showing the formed shelf support member and elastic band when in folded position.
Figure 6:
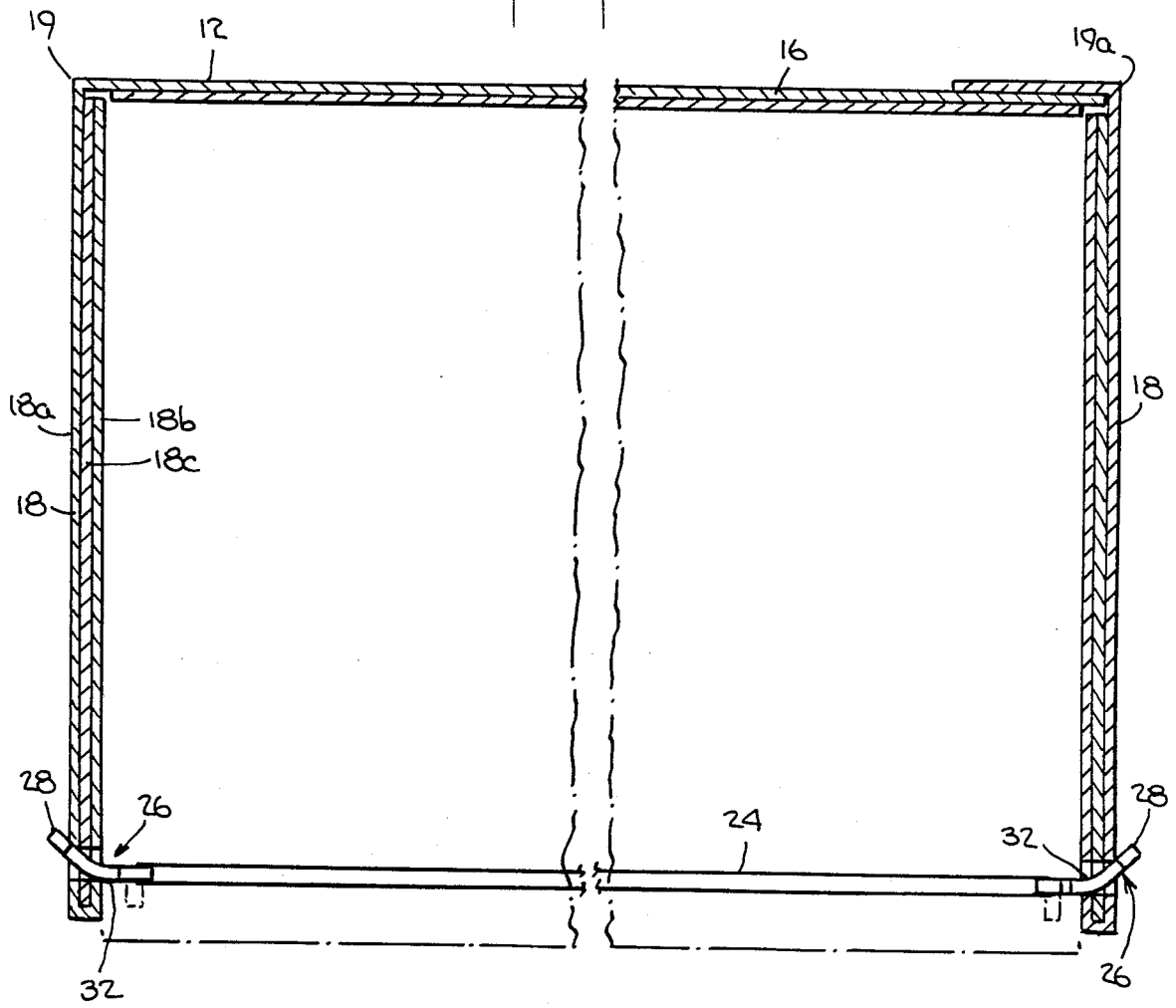
FIG. 6 is a cross-sectional view taken across line 6—6 of FIG. 5. The position of the cross-section is immediately below a shelf to show the support means for the shelf.
Figure 7:
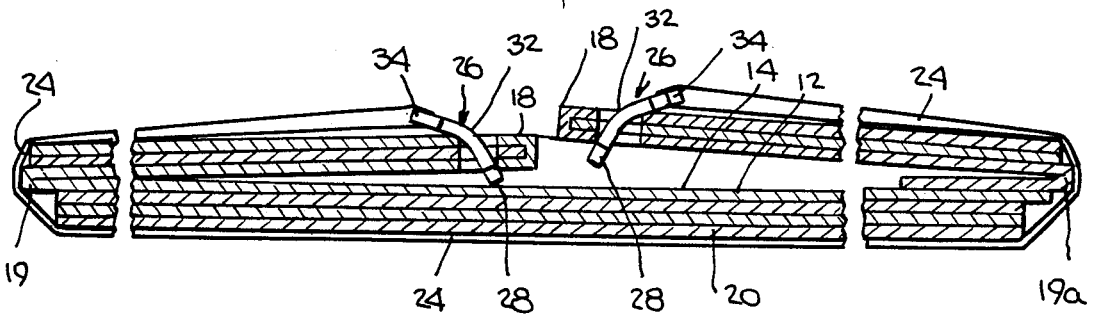
FIG. 7 is a cross-sectional view taken across line 7.7 of FIG. 4.

Formed shelf support members 26 extend laterally inwardly of side walls 18 when in unfolded display position. When unit 10 is folded to compact dimensions as shown in FIGS. 4 and 7, the tension of elastic bands 24 is now parallel to the surface of each side wall member 18 and not perpendicular thereto. The combination of curved link member 32 and elongated hole 38 permits formed shelf support member 36 to rotate so that load-bearing section 30 is now more parallel to side wall 18 rather than perpendicular thereto under display conditions. This change may be readily seen in a comparison of FIG. 6 (display position) and FIG. 7 (folded position).

In order to provide the load-bearing side wall members 18 with sufficient strength, a triple wall construction of corrugated board is used in the preferred embodiment. As may be seen in FIG. 6, the triple board is formed by folding the board member inwardly 180° to form a double wall and providing a third corrugated board layer in between, the three layers being suitably bonded to each other for strength. As shown in FIG. 6, each side wall member 18 comprises an outer wall 18A folded back upon itself to form inner side wall 18B with an intermediate layer 18C. It is of particular importance to the invention that outer layer 18A is hinged to rear wall member 12, preferably by being formed integrally with rear wall member as at the upper left of FIG. 6 or being adhesively secured or otherwise bonded to rear wall member 12 as at the upper right in FIG. 6. There is thus no interference when each side wall member 18 is rotated to folded position as shown in FIG. 7. Because there is no need to rotate side wall members 18 inwardly with respect to front face 14 of rear wall member 12, but only bring the side wall members to a substantially perpendicular relation to rear wall member 12, as shown in FIG. 6, there is no need to provide inner hinge clearance at either hinge 19 or inner hinge 19A and accordingly both inner layer 18B and intermediate layer 18C may be extended all the way to hinge 19 and 19A, rather than needing to stop short thereof. By extending all the way to the hinge edges, side wall members 18 are strengthened. Shelves 20 may be formed similarly to side wall members 18 as respects the triple layer construction. Of course, for additional strength, additional board layers may be added as needed since there are not clearance problems necessary at the hinge lines.

While the foregoing is illustrative of a preferred form of the invention, it is clear that other forms and modifications may be had within the spirit of the invention. For example, while corrugated board has been described as the preferred material, it is clear that suitable alternative materials may be employed.

What is claimed is:

1. A foldable corrugated board display unit, comprising:

a. a rear wall;

b. a pair of opposed side walls, said pair of opposed side walls each being hingedly secured to said rear wall for folding from substantially perpendicular to the front face of said rear wall to substantially parallel to and adjacent said back face of said rear wall;

c. a plurality of shelf members, said shelf members being hingedly secured to said front face of said rear wall member;

d. shelf support means, said shelf support means comprising a plurality of formed shelf support members secured to said side wall members, said shelves being foldable to a substantially horizontal load-bearing position onto said shelf support members for engagement therewith and support thereon;

e. extendable tension means, said extendable tension means extending between opposite pairs of said shelf support members, and tensioning said side wall members against said shelves when in display position and tensioning against said shelves holding them in folded position against said front face of said rear wall member when in folded position;

f. said shelf support means further comprising side wall engaging locking bar means, load-bearing means and curved link member means, said curved link member means connecting between said side wall engaging locking bar means and said load-bearing means, g. said load-bearing means comprising shelf-support surface means, shelf-engaging pin means extending in a substantially upward direction from said shelf-support surface means, and side wall support flange means extending in a substantially downward direction, h. said shelf-support surface means supporting the underside of said shelf members and at least a portion of the load thereon when in load-bearing position, said shelf-engaging pin means extending at least into said shelf members and said side wall support flange means engaging against said side walls and transferring at least a portion of the load to said side walls whereby said side walls support said shelf members and at least a portion of the load thereon.

2. A foldable corrugated board display unit in accordance with claim 1 additionally comprising:

(a) a plurality of horizontally elongated openings formed in and through said side walls;

(b) said side wall engaging locking-bar means being adapted to fit through said elongated openings and turned to a substantially vertical operative position to secure against said side walls.

3. A foldable corrugated board display unit in accordance with claim 2 wherein said shelf support means additionally comprises receiving means for receiving and engaging said extendable tension means.

* * * * *